United States Patent [19]

Boulanger

[11] 4,086,451

[45] Apr. 25, 1978

[54] KEYBOARD APPARATUS

[75] Inventor: Henry J. Boulanger, Cumberland, R.I.

[73] Assignee: Texas Instruments Incorporated, Dallas, Tex.

[21] Appl. No.: 747,655

[22] Filed: Dec. 6, 1976

[51] Int. Cl.[2] ..... H01H 13/70

[52] U.S. Cl. ..... 200/5 A; 200/159 B; 200/329

[58] Field of Search ..... 200/5 A, 5 R, 159 A, 200/159 B, 329

[56] References Cited

U.S. PATENT DOCUMENTS

| | | | |
|---|---|---|---|
| 3,584,162 | 6/1971 | Krakinowski | 200/159 B X |
| 3,590,195 | 6/1971 | Driver | 200/159 B |
| 3,600,528 | 8/1971 | Leposavic | 200/159 B X |
| 3,684,842 | 8/1972 | Boulanger | 200/159 B X |
| 3,693,775 | 9/1972 | Brooks et al. | 200/5 R X |
| 3,856,998 | 12/1974 | Sims, Jr. | 200/159 B X |
| 3,952,174 | 4/1976 | Boulanger et al. | 200/5 A |

OTHER PUBLICATIONS

Harris et al.; IBM Tech. Disc. Bull; "Force Concentrator for Touch Sensitive Panel Using Snap-Action Switches;" vol. 19, No. 1, June 1976, p. 238.

Johnson, Jr.; IBM Tech. Disc. Bull.; "Keyboard with Changeable Encoding and Key Designation;" vol. 13, No. 7, Dec. 1970, pp. 2041, 2042.

*Primary Examiner*—James R. Scott

*Attorney, Agent, or Firm*—John A. Haug; James P. McAndrews

[57] ABSTRACT

A low profile keyboard having a flat cover to enhance appearance and facilitate cleaning. Tactile feedback of switch actuation is provided by using snap acting discs for the switches and tactile feedback members interposed between the discs and the cover. Feedback members of several forms are shown including a discrete member for each disc as well as a member for several discs.

12 Claims, 8 Drawing Figures

KEYBOARD APPARATUS

BACKGROUND OF THE INVENTION

This invention relates generally to keyboards and more particularly to low profile keyboards having tactile feedback of switch actuation.

Keyboards which have a low profile, that is keyboards that are thin, are well known in the art. Such keyboards are particularly useful where it is desired to use as little space as possible, as in television tuners, hand held calculators and the like. One of the characteristics inherent in low profile keyboards of course is that the distance the key travels to effect actuation of the switch controlled by the key is short compared to the type of key switch known in the art as desk top or travel type key switches such as those frequently used in computer terminals, typewriters and the like where more space is available and in applications where the operator is accustomed to experience more key travel for key switch actuation to provide assurance that a switch has in fact been actuated upon depression of the respective key.

In low profile keyboards it is also highly desirable to provide assurance to the operator that the switches are actuated when the keys are depressed. One way that this is accomplished in prior art keyboards is by employing snap acting members in conjunction with the keys. That is, the key is arranged so that upon depression by a user, force is applied to a snap acting member such as a dished shaped disc which snaps from a convex configuration through a plane formed by the periphery of the disc to a concave configuration thereby causing actuation of a switch. The sudden movement of the disc as it snaps from the one configuration to the other is tactily felt by the operator through the key. Examples of this type of keyboard may be found in U.S. Pat. Nos. 3,959,611; 3,952,174 and 3,893,235 which illustrate but a few of such keyboards.

The advent of digital keyboard controls for appliances such as microwave ovens has resulted in the requirement of a keyboard which is easily cleanable and devoid of crevices which would tend to collect food particles and the like. Frequency responsive and capacitive type keyboard controls can be constructed having these characteristics by employing a flat smooth outer face having indicia thereon to identify the key locations. This type of keyboard is highly conducive to cleaning however it offers no tactile feedback and generally is more expensive than an electromechanical keyboard.

Keyboards of the type set forth in the above patents, as previously stated, provide excellent tactile feedback even with a thin layer of flexible electrically insulative material such as polyethylene teraphthalate to seal the switches and maintain the disc elements in their proper location; however, if a flat relatively stiff membrane is disposed over these keyboards, for instance to facilitate cleaning by providing a flat smooth outer face, the tactile feedback is deleteriously affected. The membrane requires a certain amount of inherent stiffness in order to maintain its flatness however this stiffness effectively masks the tactile feedback.

It is therefore an object of this invention to provide a low profile keyboard which is easily and readily cleanable as well as one which provides tactile feedback of switch operation. Another object is the provision of a keyboard which is inexpensive yet reliable having a flat, smooth top surface with tactile feedback of switch operation. Yet another object is the provision of a tactile feedback keyboard having snap acting discs with a flat cover overlying the discs with indicia marked thereon to identify the location of keys. Another object is the provision of means to ameliorate switch actuation when an operator depresses the top surface at a location somewhat off center of a key switch. Other objects and features will be in part apparent and in part pointed out hereinafter.

Briefly, in accordance with this invention keyboard apparatus having a flat top surface overlies a substrate mounting a plurality of spaced stationary contacts and intermediately disposed electrically conductive, snap acting disc elements which upon depression are snappable from a first convex configuration to a second concave configuration and are so arranged that snapping of a disc switches or closes a circuit path. Tactile feedback of switch actuation is obtained by interposing a tactile feedback member between the discs and the flat top surface. Several different tactile feedback members are shown including rigid plate like members captured in a frame circumscribing each disc or secured to a sheet so that a plate member is held at each switching station. The sheet can be the flat cover itself with the individual plate like members adhered to the bottom surface thereof or it can be a separate carrier sheet provided with apertures which receive depending posts from the tactile feedback members subsequently headed over in rivet like fashion to securely attach the members to the carrier sheet. In another embodiment the member comprises a single sheet of material extending over two or more switching stations with protrusions formed in the sheet aligned generally with the center of the discs. Ribs may be formed in the sheet extending from each protrusion to add rigidity to the localized area adjacent the protrusions thereby permitting the switching stations to be spaced further apart. Motion decoupling means may be employed to prevent motion from one switching station from affecting adjacent switching stations. The decoupling means is shown as a series of slots in the tactile feedback sheet extending generally along and adjacent a portion of the boundaries of each switching station or a plurality of projecting supports depending from the tactile feedback sheet, the supports located adjacent the boundaries of the switching stations and extending from the sheet in the same direction as the protrusions.

BRIEF DESCRIPTION OF THE DRAWING

Corresponding reference characters indicate corresponding parts throughout the several views of the drawings. Dimensions of certain of the parts as shown in the drawings may have been modified or exaggerated for the purposes of clarity of illustration.

DETAILED DESCRIPTION OF THE PREFERRED EMBODIMENT

Figure 1:
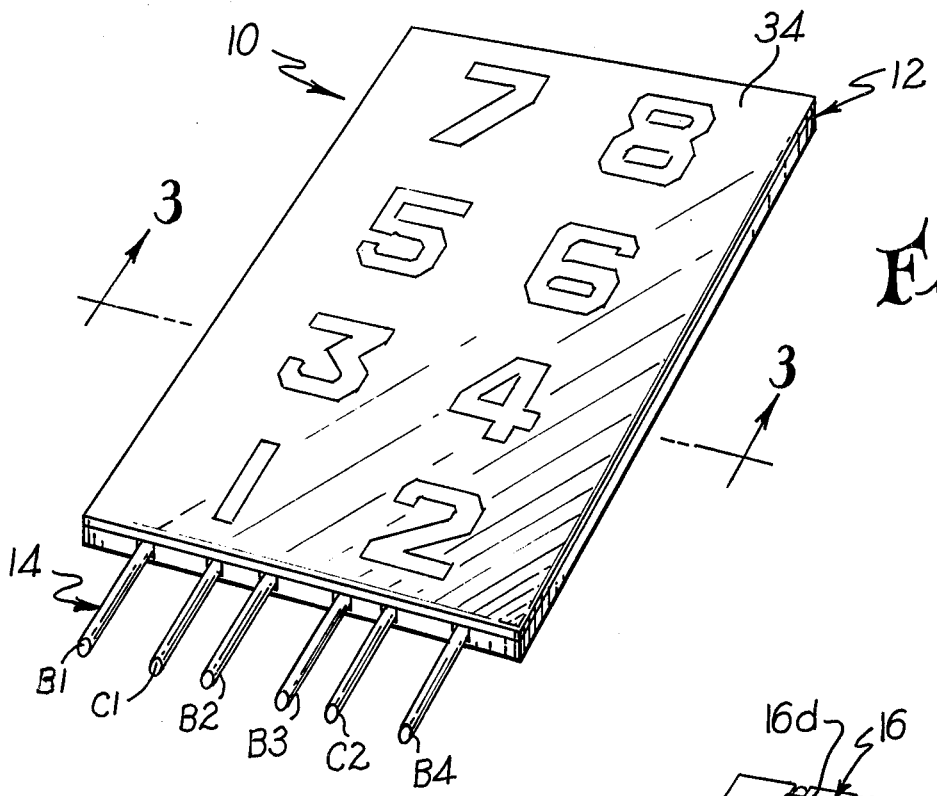
FIG. 1 is a perspective view of a keyboard device made in accordance with the invention.
Figure 2:
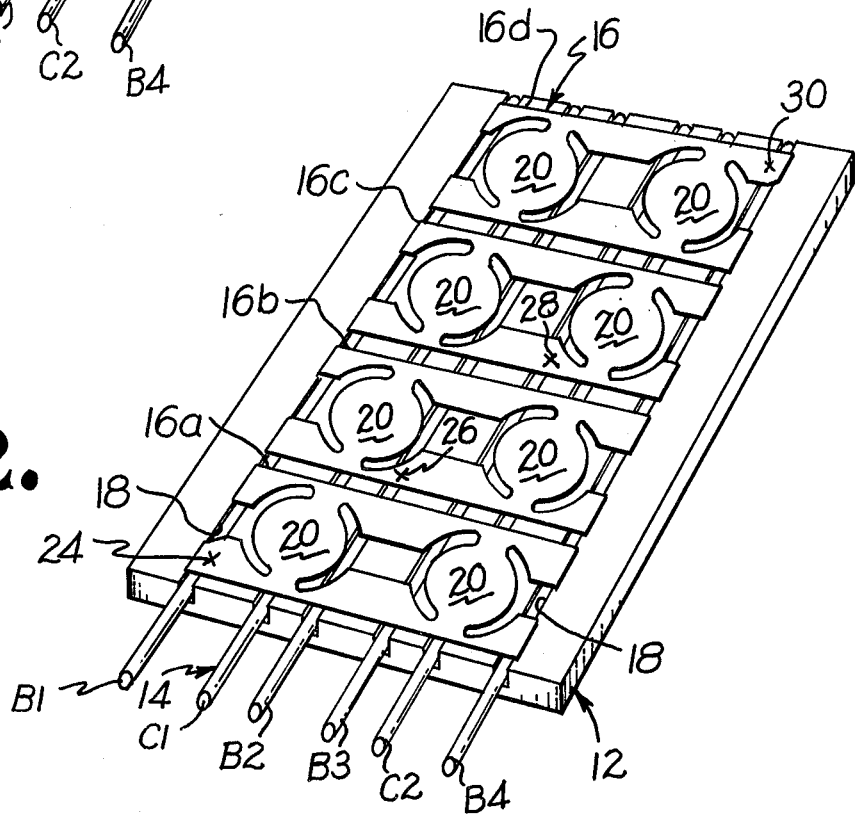
FIG. 2 is a perspective view similar to FIG. 1 but with the top portion of the device removed so that the disc elements are visable.
Figure 3:
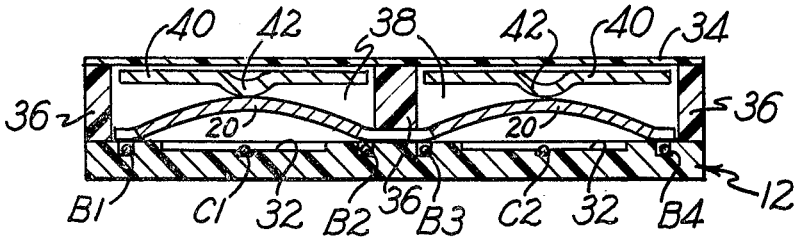
FIG. 3 is a cross section view taken on lines 3—3 of FIG. 1.

Referring now to the drawings, particularly FIGS. 1–3, numeral 10 denotes a keyboard device made in accordance with the invention. Keyboard device 10 includes a substrate 12 on which are disposed a plurality of electrically conductive wires 14 and a plurality of electrically conductive strips 16. Substrate 12 is preferably formed of an inexpensive moldable, electrically insulative, resinous material, such as acrylonitrile-butadiene-styrene (ABS), in which a plurality of parallely extending grooves 18 are formed. Electrically conductive bus wires B1, B2, B3 and B4 and contact wires C1 and C2 are received in respective grooves and disposed slightly below the top surface of the substrate to provide electrical separation between the wires and the strips except as noted below. The wires are held securely in their respective grooves by any convenient means, as by deforming portions of the substrate contiguous to the grooves thereby forcing the ABS material onto portions of the wires to lock them in their seats.

Electrically conductive strips **16*a*, 16*b*, 16*c* and 16*d* are disposed on the top surface of substrate 12 extending transversely across wire 14. Strips 16 are formed with dome or disc shaped portions 20 which are concave-convex circular members of electrically conductive material, such as a relatively thin sheet of brass and having an initial convex position, i.e., the center of disc 20 is further away from the substrate than the outer margin thereof. Each disc is movable independently of the others by resiliently depressing it partially over center from its initial convex position in which the center of the disc is clear of the contact wire disposed beneath it to an actuated position in which the central portion of the disc engages the wire. Cut out portions 22 separates the discs of a particular strip from one another and permits actuation of one disc without affecting other discs in the strip. Disc strip 16*a* is electrically connected to bus wire B1 as by bending wire B1 upwardly to form a weld projection and welding at 24, likewise strip 16*b* is welded to bus wire B2 at 26, strip 16*c* is welded to bus wire B3 at 28 and strip 16*d* is welded to bus wire B4 at 30. Thus it will be seen that for each strip or row of discs a bus wire is provided. As seen in FIG. 2 each left hand disc in the several disc strips forms a first column of discs and each right hand disc in the strips forms a second column of discs. Contact wire C1 extends under the first column of discs while contact wire C2 extends under the second column of discs. It will be understood that the particular number of discs or switching stations provided is a matter of choice. A recess 32 is provided in the substrate under each disc 20 so that snap actuation of a disc 20** from its convex configuration shown in the drawings to the opposite concave configuration will cause the central portion of the disc to engage the contact wire disposed underneath the disc. Actuation of any disc will close or switch a unique circuit. More information on switching systems of this type may be obtained in copending application Ser. No. 747,654, filed Dec. 6, 1976.

A flat smooth cover membrane 34 overlies substrate 12 and is provided with indicia thereon, in any suitable manner as by stencilling, to identify the location of the switching stations. Membrane 34 is preferably formed of material which is dimensionally stable, tough, heat resistant and relatively stiff having elastic properties and thickness such that it will return to its apparent flat condition following depression. One such material found to be suitable is a thermoplastic polycarbonate resin such as LEXAN resin, a trademark of General Electric Company. The top surface of membrane 34 may be decorated to enhance its appearnace, for instance to render a suede effect. Membrane 34, which may be in the order of 0.010 inches in thickness, is attached to frame 36 in any suitable manner as by employing a conventional pressure sensitive adhesive. As seen in FIG. 3 frame 36 defines a cavity 38 at each switching station and disposed therein intermediate cover membrane 34 and a disc 20 is a tactile feedback member 40 which is a rigid plate like member, e.g., of stamped aluminum, having a protrusion 42 formed therein generally at its center and depending downwardly toward the disc therebeneath. Tactile feedback of switch actuation, i.e., the snapping of disc 20 from a convex to a concave configuration closing a circuit path, is transmitted from the disc to the operator through member 40 and protrusion 42 even when the operator depresses the cover membrane slightly off the center of the disc. As noted above, when membrane 34 is placed directly over the snap acting discs to provide a flat surface but without the tactile feedback members the snap action feel is masked by the membrane. Further, even if the operator depresses cover membrane 34 at a switch station somewhat off center of the respective disc 20 member 40 ameliorates switch actuation by focusing the applied force through protrusion 42.

Figure 4:
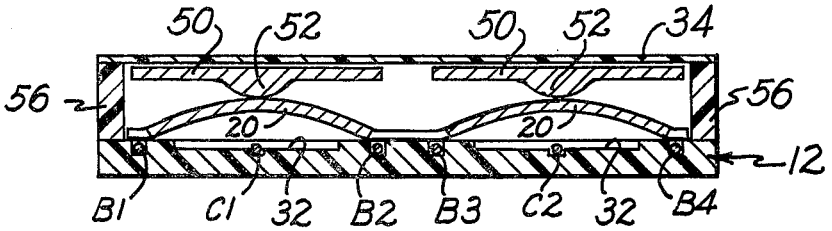
FIG. 4 is a cross sectional view similar to FIG. 3 but showing a second embodiment of the invention.

In FIG. 4 disparate tactile feedback members 50 may be adhesively attached directly to cover membrane 34, as by using pressure sensitive adhesive. Thus frame 56 may be placed about the outer periphery of the substrate without separating each switching station from one another. Tactile feedback members 50 are formed with protrusions 52 depending therefrom to focus the force to and from the center of the disc located therebeneath. Members 50 may be accurately located on cover membrane 34 in any convenient way as by preplacing the members in a jig with pressure sensitive adhesive either on their upper flat surface or on the bottom surface of cover membrane 34 and then pressing the cover membrane onto the members and lifting the entire assembly from the jig. This obviates the need for providing a separate cavity at each switch station while still providing a separate tactile feedback member for each switching station.

Figure 5:
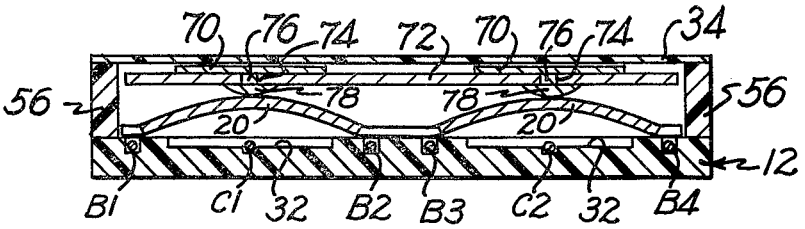
FIG. 5 is a cross sectional view similar to FIG. 3 but showing another embodiment of the invention.

Yet another tactile feedback arrangement is shown in FIG. 5 in which tactile feedback members 70 are mechanically locked to a carrier sheet 72. Carrier sheet 72 is provided with a plurality of apertures 74 through which pass posts 76 depending from tactile feedback members 70. The free end of the posts are headed over at 78 in rivet like fashion to form the tactile feedback protrusions. This embodiment is particularly useful in applications which may cause excessive adhesive aging or failure such as in certain high temperature conditions.

Figure 6:
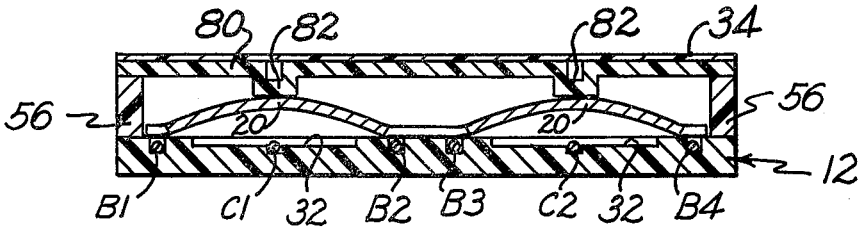
FIG. 6 is a cross sectional view similar to FIG. 3 but showing yet another embodiment of the invention.

FIG. 6 depicts another embodiment of a tactile feedback member in which a sheet of plastic material 80 such as rigid vinyl is interposed between the discs 20 and the cover membrane 34 and extends over the switching stations. Protrusions 82 are formed in the sheet, as by using conventional vacuum forming techniques, and are located so that a protrusion is disposed generally over the center of each disc. In this embodiment frame 56 may be placed about the outer periphery of the substrate in the same manner as in the FIG. 4 embodiment without separating each switching station from one another. When sheet 80 is depressed near protrusion 82 the location of which is coincident with the indicia on the cover membrane identifying the switching stations, the protrusion engages the center of the disc causing snap action. Since the protrusion contacts the disc at its center the maximum tactile feedback is transmitted to the operator's finger.

Figure 7:
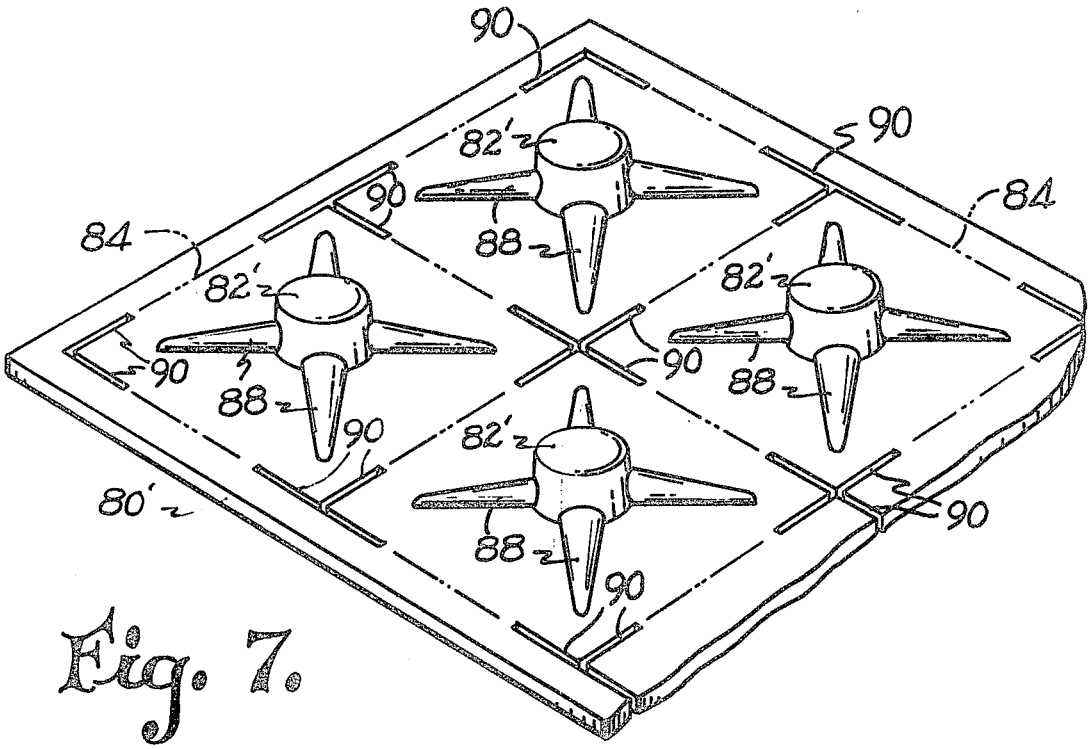
FIG. 7 is a perspective view of a tactile feedback member useful in the apparatus of the invention, the member being shown inverted relative to its assembly in the apparatus as shown in the previous FIGS. in order to show certain features more clearly.

In some instances it may be desirable to increase the stiffness of the tactile feedback sheet in the vicinity of the protrusion. For example, if wider spacing of the switching stations is desired ribs 88, as seen in sheet 80' of FIG. 7 may be vacuum formed in the sheet extending from projection 82'. This will extend the area that will transmit force to and from the center of the respective disc. In order to prevent force from being transmitted to an adjacent disc, particularly when the operator depresses a key off center, motion decoupling means may be provided in the form of slots 90 extending generally along and adjacent to a portion of the boundaries of each switching station (see phantom line 84 generally denoting the boundaries of the switching station when sheet 80' is mounted on frame 56).

Figure 8:
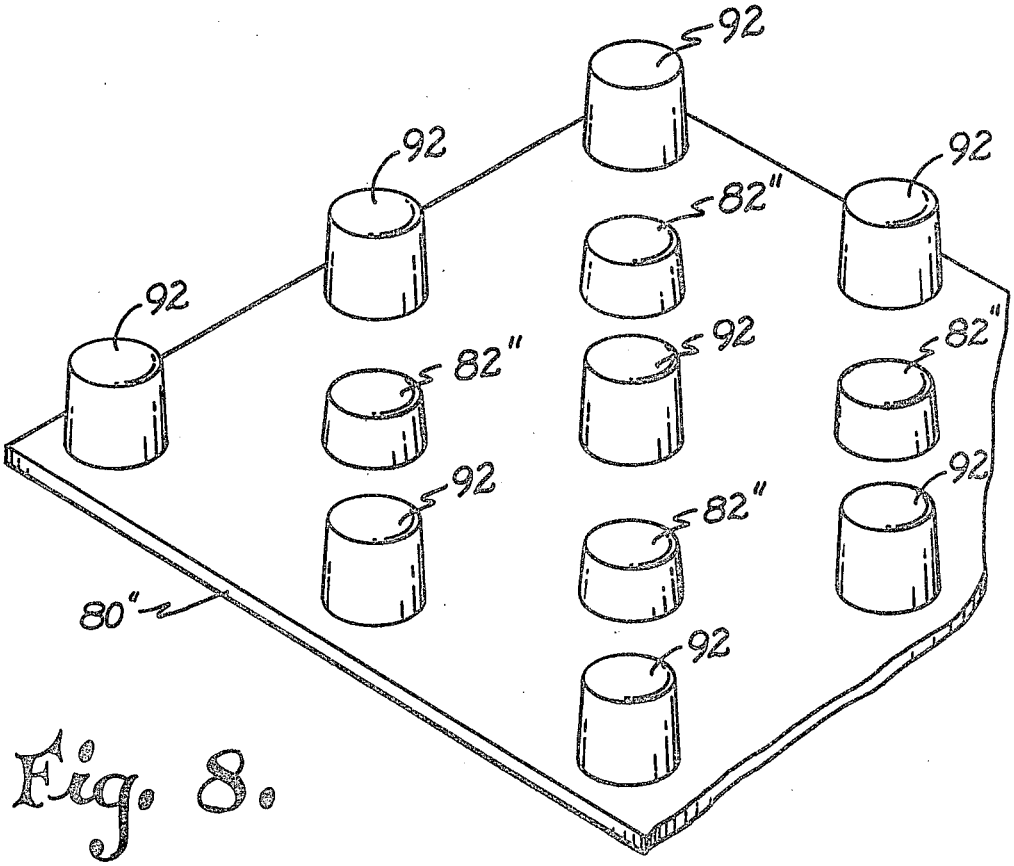
FIG. 8 is a perspective view of another tactile feedback member useful in the apparatus of the invention, the member shown inverted in the same manner as FIG. 7.

Another motion decoupling means is shown in FIG. 8 and comprises a plurality of projecting supports 92 depending from tactile feedback sheet 80''. Supports 92 are also located adjacent the boundaries of each switching station and extend from sheet 80'' a greater distance than and in the same direction as protrusion 82''. As shown in FIG. 8 the supports 92 located along the outer periphery of sheet 82'' serve the function of frame 56. If desired supports 92 located along the outer periphery of the sheet may be replaced with a frame member such as frame 56 of FIGS. 3–5. It will be understood that in other structures supports 92 need not necessarily extend from sheet 80'' a greater distance than protrusions 82''; as long as they support sheet 80'' on the substrate they will be effective in decoupling motion of one protrusion 82'' from other ones.

Thus it will be seen that the invention provides a keyboard having a flat top surface area which is easily cleanable but which also has excellent tactile feedback characteristics. The tactile feedback mechanism is reliable yet can be provided at a very low cost, for example by employing a conventional vacuum forming technique or using stamped parts. The several objects of the invention are achieved and other advantageous results attained. It will be understood that although an XY matrix type of keyboard with tactile feedback is illustrated herein that any type of contact system may be employed.

In the foregoing specification, the invention has been described with reference to specific exemplary embodiments thereof. However it will be evident that various modifications and changes may be made thereunto without departing from the broader spirit and scope of the invention as set forth in the appended claims. The specification and drawings are, accordingly, to be regarded in an illustrative rather than in a restrictive sense.

I claim:

1. Keyboard apparatus having a plurality of switching stations comprising a substrate having a top surface, a plurality of spaced stationary electrical contacts disposed on the substrate, a plurality of snap-acting electrically conductive disc elements disposed on the substrate overlying the stationary contacts, each disc element disposed at a switching station, each disc element adapted to move into and out of engagement with a stationary contact, means to connect the disc elements and the contacts to an electrical source, a thin cover having a flat top surface mounted on the substrate overlying the top surface and spaced therefrom, the cover having indicia to identify the location of the switching stations, and tactile feedback means disposed intermediate each disc and the flat cover, the tactile feedback means comprising a separate rigid plate like member for each switching station having a protrusion extending therefrom, the protrusion generally aligned with and extends toward the center of a respective snap acting disc whereby upon depression of the cover at a switching station by an operator's finger the feel of the sudden snapping of the disc from an unactuated position in which the disc element is out of engagement with any stationary contact to an actuated position in which the disc element is in engagement with a stationary contact is transmitted to the operator's finger.

2. Keyboard apparatus according to claim 1 further including a frame means disposed intermediate the substrate and the cover, the frame means defining peripheral boundaries for each switching station, and the tactile feedback member loosely positioned within the peripheral boundary of each switching station.

3. Keyboard apparatus according to claim 1 in which the rigid members are secured to the overlying cover to maintain them in their desired location.

4. Keyboard apparatus according to claim 1 in which the rigid members are secured to a layer which overlies more than one switching station.

5. Keyboard apparatus according to claim 4 in which a plurality of apertures are formed in the layer, the rigid members are each formed with a depending post having a free end which is received in a respective aperture, the free end deformed to lock the rigid member to the layer and serve as a force transmitter to and from the disc.

6. Keyboard apparatus according to claim 1 in which the stationary contacts comprise an electrically conductive wire supported on the substrate and the discs are formed in strips, each strip comprising more than one disc.

7. Keyboard apparatus according to claim 6 in which the means to connect the disc elements to an electrical source includes an electrically conductive bus wire supported on the substrate for each strip of discs and is electrically connected thereto.

8. Keyboard apparatus having a plurality of switching stations comprising a substrate having a top surface, a plurality of spaced stationary electrical contacts disposed on the substrate, a plurality of flexible electrically conductive elements disposed on the substrate overlying the stationary contacts, each flexible element disposed at a switching station, each flexible element adapted to move into and out of engagement with a stationary contact, means to connect the flexible elements and the contacts to an electrical source, a thin cover having a flat top surface mounted on the substrate overlying the top surface and spaced therefrom, the cover having indicia thereon to identify the location of the switching stations, and force transmitting means comprising a sheet of material having a protrusion aligned generally with the center of each flexible element and ribs formed in the sheet extending from the protrusion to stiffen the sheet near the protrusion, the force transmitting means disposed intermediate each flexible element and the flat cover whereby force depressing the cover at a switching station by an operator's finger will be transmitted to the center of the respective flexible element to facilitate movement of the flexible element from an unactuated position in which the flexible element is out of engagement with any stationary contact to an actuated position in which the flexible element is in engagement with a stationary contact.

9. Keyboard apparatus according to claim 8 in which the force transmitting sheet is composed of a thermoplastic resinous material and the protrusions are vacuum formed.

10. Keyboard apparatus according to claim 8 in which motion decoupling means are formed in the force transmission sheet so that motion of the sheet at one switching station will not cause motion at other switching stations.

11. Keyboard apparatus according to claim 10 in which the motion decoupling means comprise a plurality of slots formed in the force transmitting sheet extending generally along and adjacent a portion of the boundaries of each switching station.

12. Keyboard apparatus according to claim 10 in which the motion decoupling means comprise a plurality of projecting supports depending from the force transmitting sheet, the projecting supports located adjacent the boundaries of each switching station and extending in the same direction as the protrusions.

* * * * *